US006277245B1

(12) United States Patent
Alankar et al.

(10) Patent No.: US 6,277,245 B1
(45) Date of Patent: Aug. 21, 2001

(54) DANDY PAN CONSTRUCTION FOR REDUCED SURFACE CRACKING

(75) Inventors: Gopal Alankar, Fairport; Thomas A. Lemen, Dansville; Heather J. T. Lieb, Rochester, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/521,122

(22) Filed: Mar. 7, 2000

Related U.S. Application Data

(63) Continuation-in-part of application No. 09/037,208, filed on Mar. 10, 1998, now abandoned.

(51) Int. Cl.[7] ..... D21F 1/66
(52) U.S. Cl. ..... 162/314; 162/357; 162/DIG. 7
(58) Field of Search ..... 162/DIG. 7, 314, 162/357; 492/32

(56) References Cited

U.S. PATENT DOCUMENTS 2,947,356 * 8/1960 Hornbostel ..... 162/314
5,076,894 * 12/1991 Simmons et al. ..... 162/352
5,338,408 * 8/1994 Marx, Jr. ..... 162/301

* cited by examiner

*Primary Examiner*—Karen M. Hastings

(57) ABSTRACT

A dandy pan for use with a dandy roll in the manufacturing of paper material. The construction of the dandy pan provides for reduced cracking in the surface of the dandy pan. The dandy pan includes a base portion and a top portion attached to the base portion to define an area through which steam is circulated to heat the dandy pan. A plurality of ribs are disposed in the base portion within the area. Each of the plurality of ribs is secured to the top portion by at least one weld. A spacing of the ribs of equal to or less than approximately nine inches reduces stresses on the top portion of the dandy pan. In a preferred embodiment, the ribs are spaced approximately eight inches apart.

5 Claims, 5 Drawing Sheets

DANDY PAN CONSTRUCTION FOR REDUCED SURFACE CRACKING

CROSS-REFERENCE TO RELATED APPLICATIONS

This is a continuation-in-part of application Ser. No. 09/037,208, filed Mar. 10, 1998 now abandoned, entitled "DANDY PAN CONSTRUCTION FOR REDUCED SURFACE CRACKING" by Gopal Alankar, et al.

FIELD OF THE INVENTION

The present invention relates generally to dandy rolls for paper making machines, and more particularly, to a construction of a dandy pan to reduce surface cracking.

BACKGROUND OF THE INVENTION

A dandy roll is used in the manufacturing of paper. The purpose of the dandy roll is to smooth the paper and apply a finish to the paper as the paper moves under the dandy roll. The dandy roll eliminates bubbles, foam, and major inequalities in formation, compacts the fibers, and may mark the paper with a watermark pattern. In large paper making machines, the dandy roll is of considerable weight.

FIGS. 1 and 2 illustrate a dandy roll disclosed in U.S. Pat. No. 2,947,356. A dandy roll 10 includes an end plate 12 having an outwardly extending annular flange 14. At the opposite end of dandy roll 10 is an end plate 17 from which extends an integrally formed, elongated, hollow journal 18. Extending between end plate 12 and 17 is a framework (not shown) supporting a screen 20 which forms the surface of dandy roll 10 and may bear patterns for watermarking. A pair of rollers 26 are mounted on spaced brackets 22 by means of pins 24. An annular shoe 16 on dandy roll 10 is in rolling engagement with rollers 26. A bearing 28 supports hollow journal 18. Means for driving dandy roll 10 may be affixed to the outer end of journal 18, for example, a pulley, gear, or sprocket. FIG. 1 shows a sprocket 30 having a plurality of circumferential grooves 31 for reception of a plurality of driving V-belts (not shown). Flange 14 defines an opening in end plate 12 through which extends one of a support bar 32. Support bar 32 supports a water tray 40, also referred to as a dandy pan 40. Dandy pan 40 is fixed while dandy roll 10 is rotated thereabout. A spray pipe 42 provides liquid spray droplets to wash fibers and other paper debris from screen 20, through the openings in screen 20, and into dandy pan 40. The removal of the paper debris improves paper quality. The liquid and other debris is then removed from the dandy pan.

In the manufacturing of some types of paper, for example photographic paper, defects in the paper may adversely affect the use of the paper. Defects, such as damage to the paper finish, can occur should the liquid spray droplets be allowed to fall onto the paper. Further, moisture droplets which form on the dandy pan may also damage the paper finish should they fall onto the paper. Steam, circulated within the dandy pan, can be employed to provide a source of heat. The steam causes the dandy pan to dissipate sufficient heat energy to promote the evaporation of the moisture droplets and liquid spray droplets. The evaporation of the moisture droplets and liquid spray droplets reduces possible damage to the paper finish.

The steam circulated within dandy pan 40 can be extremely hot, for example, 225 degrees F. and 12 psi. When the liquid spray droplets fall onto dandy pan 40, cracks can occur on the surface of the dandy pan causing steam to escape. The escaping steam condenses on the paper surface, thereby adversely affecting the paper by contributing to a poor surface finish of the paper. Repairing and/or replacing the dandy pan eliminates the problem, but is expensive and reduces production. Cracks on the surface of the dandy pan have been a persistent problem. Applicant's have noticed cracks in the surface of a dandy pan within 6 to 12 months of operation.

Accordingly, a need continues to exist for a dandy pan suitable for a manufacturing environment. The dandy pan must be of a construction whereby cracks are not susceptible to forming on the surface of the dandy pan.

SUMMARY OF THE INVENTION

An object of the present invention is to provide a robust dandy pan suitable for a manufacturing environment.

A further object of the present invention is to provide a dandy pan having a construction which is not susceptible to cracking on the surface.

Still another object of the invention is to provide a dandy pan which does not require frequent repair or replacement.

These objects are given only by way of illustrative example. Thus, other desirable objectives and advantages inherently achieved by the disclosed invention may occur or become apparent to those skilled in the art. The invention is defined by the appended claims.

According to one aspect of the invention, there is provided a dandy pan for use with a dandy roll in the manufacturing of paper material. The dandy pan includes a base portion and a top portion attached to the base portion to define an enclosed area through which steam is circulated to heat the dandy pan. A plurality of ribs are disposed within the enclosed area. Each of the plurality of ribs is welded to the base portion and secured to the top portion by at least one weld. The spacing of the ribs is equal to or less than approximately nine inches. In a preferred embodiment, the ribs are spaced approximately eight inches apart.

The present invention provides a dandy pan which is robust and suited for a manufacturing environment. The present invention's dandy pan has a construction which is not susceptible to cracking, thereby reducing the need to repair or replacement the dandy pan.

BRIEF DESCRIPTION OF THE DRAWINGS

The foregoing and other objects, features, and advantages of the invention will be apparent from the following more particular description of the preferred embodiments of the invention, as illustrated in the accompanying drawings.

DETAILED DESCRIPTION OF THE INVENTION

Figure 1:
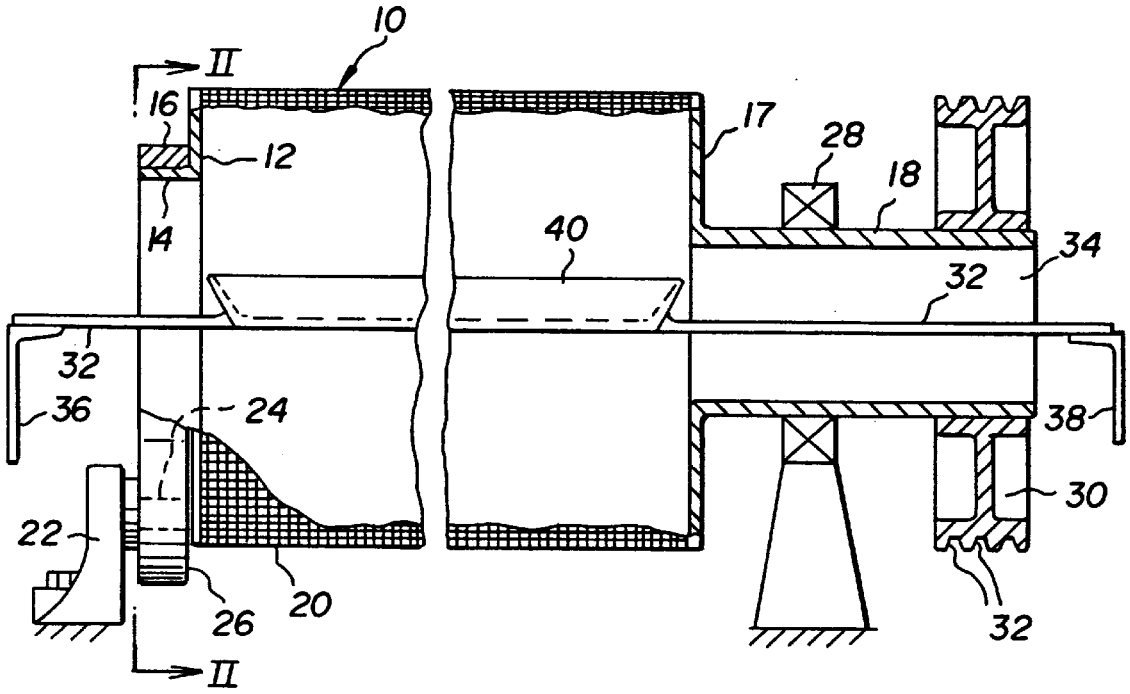
Fig. 1 PRIOR ART
FIG. 1 shows an elevational view, partly in section and broken away, of a prior art dandy roll.
Figure 2:
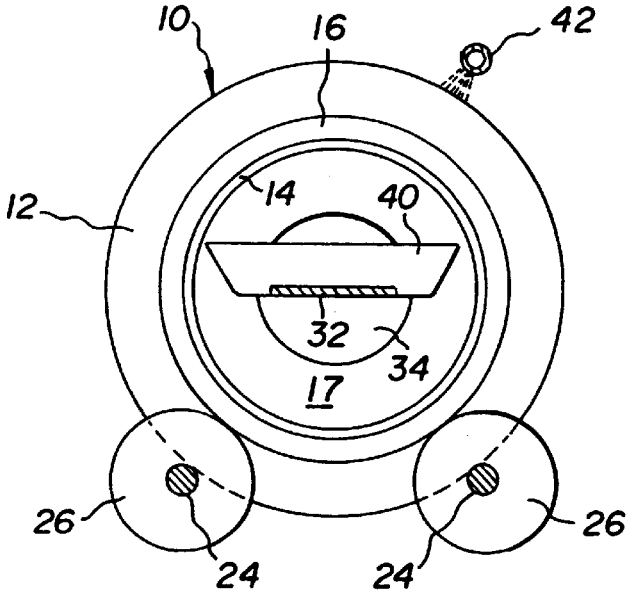
Fig. 2 PRIOR ART
FIG. 2 is prior art, showing an end elevational view, partly in section taken substantially along line II—II of FIG. 1 and showing a spray pipe in operative position.
Figure 3:
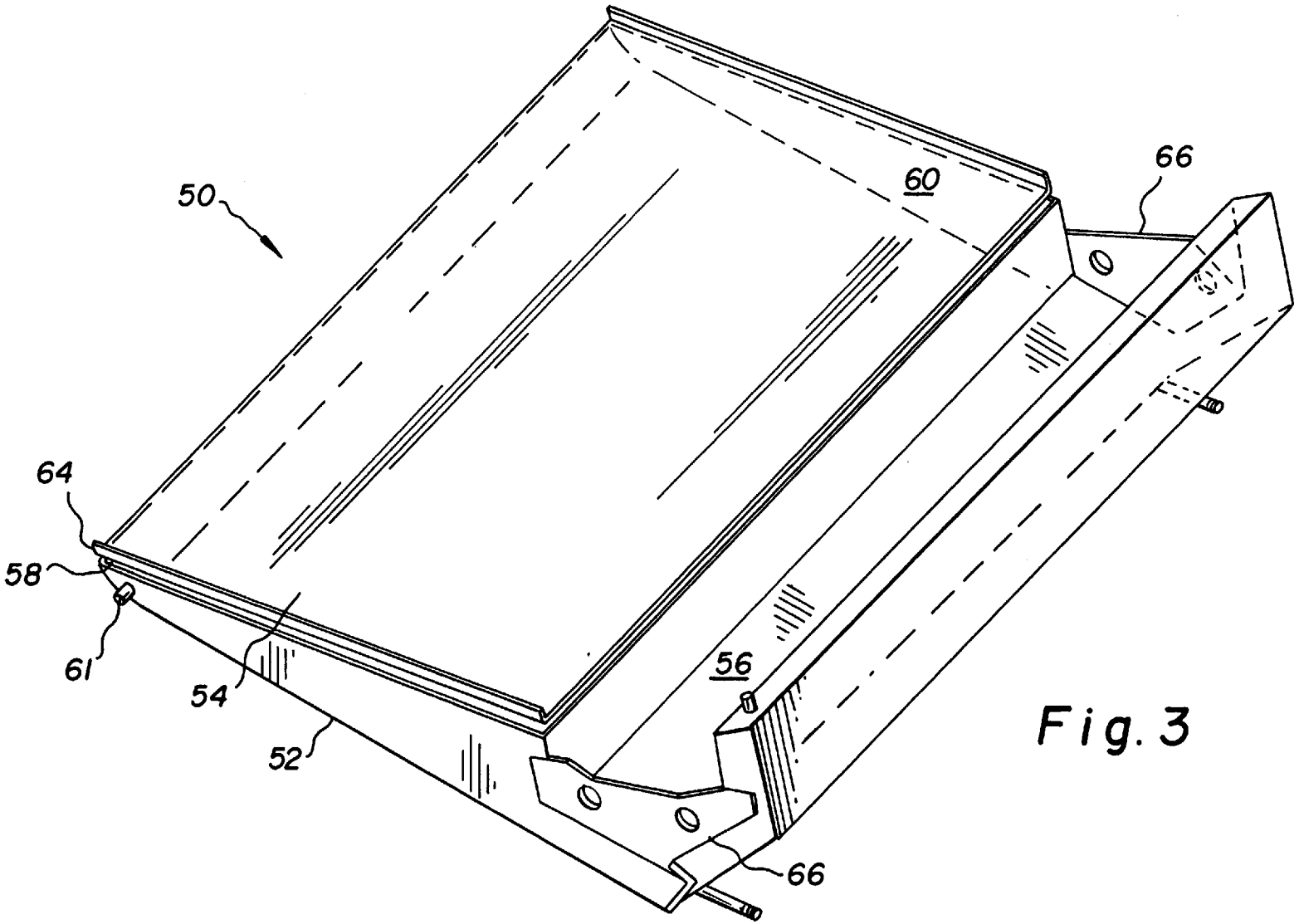
FIG. 3 shows an isometric view of a dandy pan in accordance with the present invention.
Figure 4:
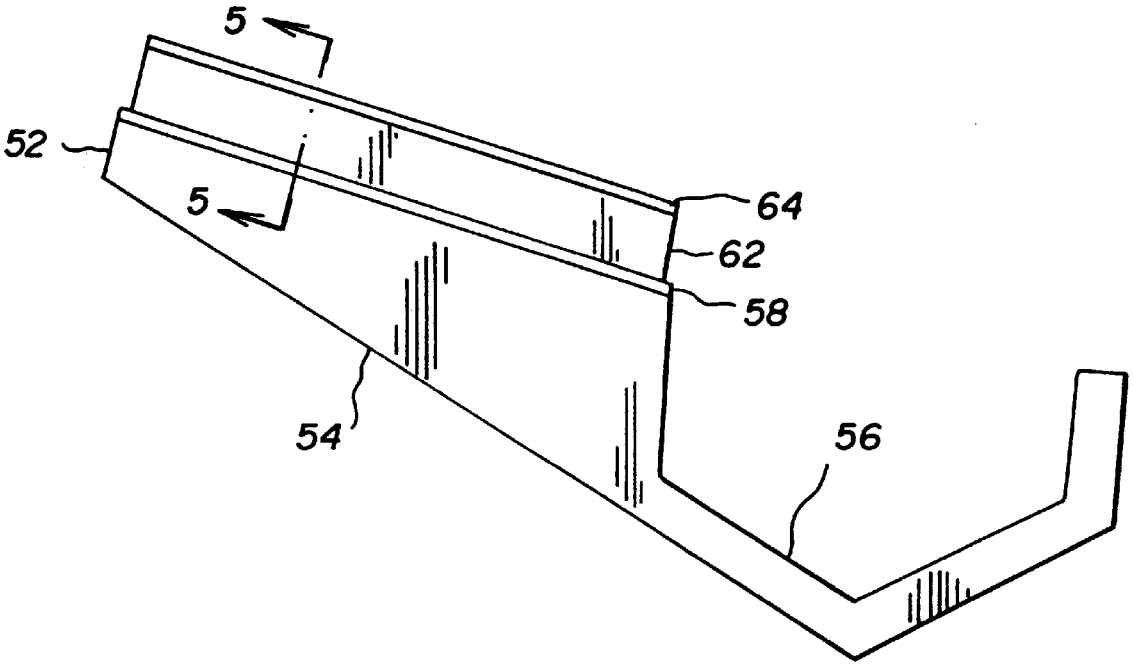
FIG. 4 shows a side view of the dandy pan of FIG. 3.

The following is a detailed description of the preferred embodiments of the invention, reference being made to the drawings in which the same reference numerals identify the same elements of structure in each of the several figures.

Figure 5:
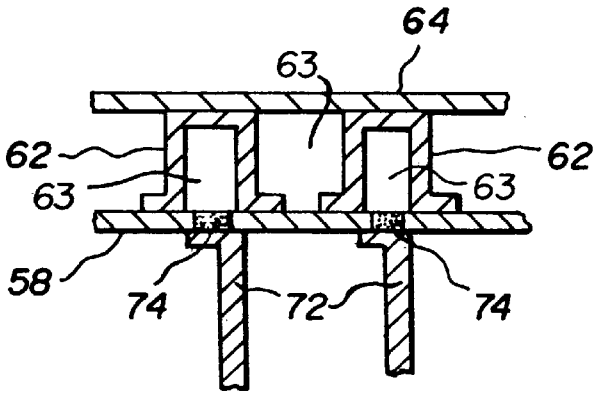
FIG. 5 shows a cross-sectional view of a portion of the dandy pan of FIG. 4 taken along line 5—5.

FIGS. 3 through 9 generally illustrate a dandy pan 50 in accordance with the present invention. Dandy pan 50 includes a base portion 52 having a non-collection area 54 and a collection area 56. A top portion 58 is fixedly attached to non-collection area 54 to define an enclosed area 60 through which steam is circulated. To reduce the evaporation of the liquid collected in collection area 56, an insulating air pocket 63 may be utilized. As illustrated in FIG. 5, insulating air pocket 63 is spaced from collection area 56 by non-collection area 54. An input 61 for the steam is provided at one end of the dandy pan. At least one bracket 62 attaches a shield 64 to top portion 58. Bracket 62 is attached to top portion 58, for example, by a tack welds (not shown) at each of the two ends of the bracket.

According to FIG. 5, a plurality of air pockets 63 are spaced from collection area 56 by non-collection area 54. These air pockets 63, importantly, enable heat dissipation from the pan that is generated by the steam. The reduction in excessive heat via air pockets 63 eliminates the condensation heretofore formed in the pan and, therefore, enabled the inventors to prevent condensation from damaging the paper material.

Dandy pan 50 is mounted inside dandy roll 10 by means of mounting supports 66, located at each end of the dandy pan. This mounting provides for the rotation of dandy roll 10 about dandy pan 50. A fluid dispenser 68 dispenses fluids (e.g., water) toward the dandy roll. Debris and water falls on top shield 64 and is collected in collection area 56. An external dandy pan 70 may be provided to control/collect the spray of the fluid dispenser.

Figure 6:
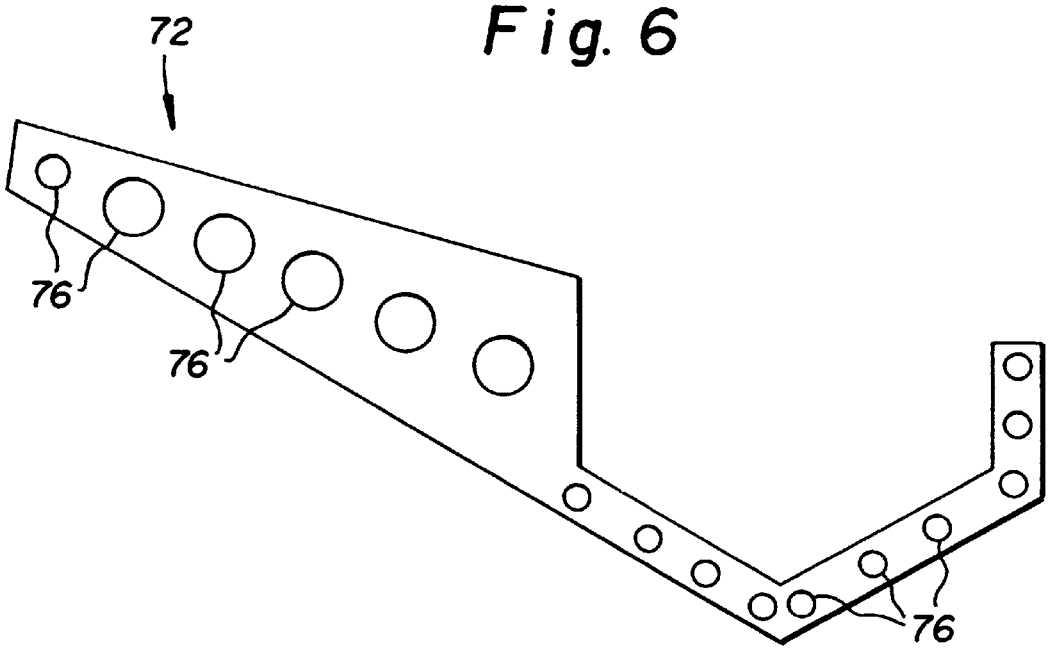
FIG. 6 shows a side view of a rib.
Figure 7:
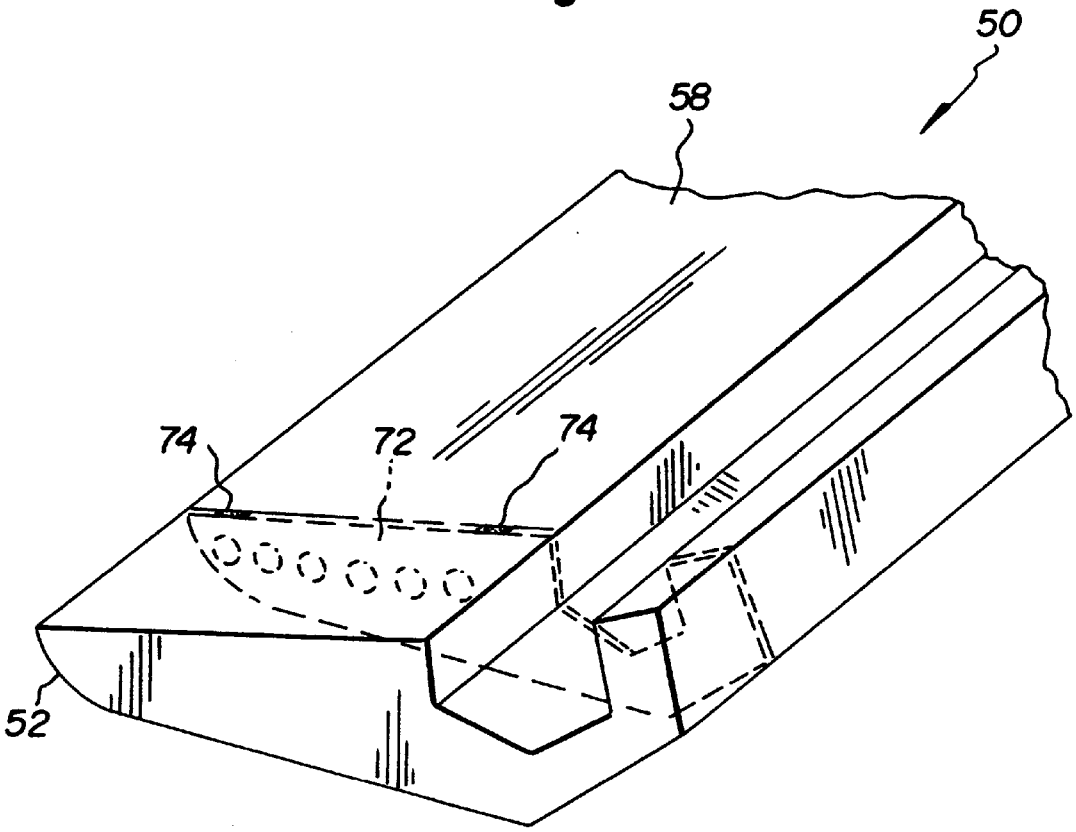
FIG. 7 shows an isometric view of the base portion and the top portion of a dandy pan, showing the placement of one rib within the enclosed area.
Figure 8:
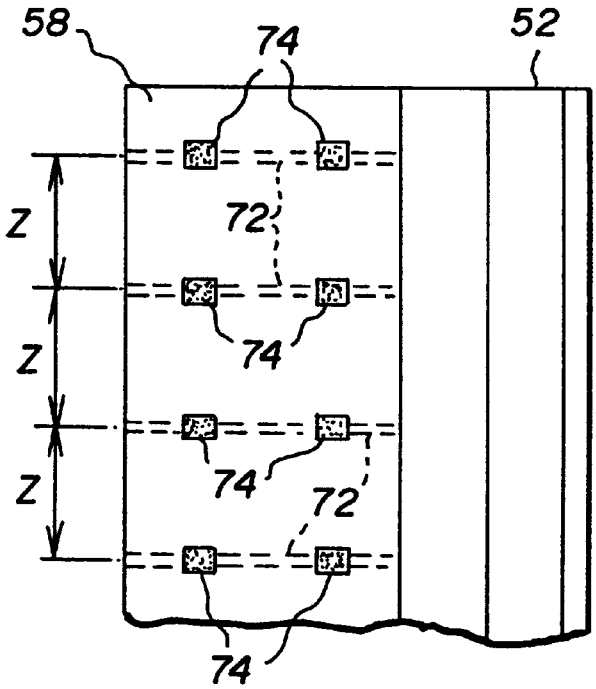
FIG. 8 shows a top view of the dandy pan illustrated in FIG. 7.
Figure 9:
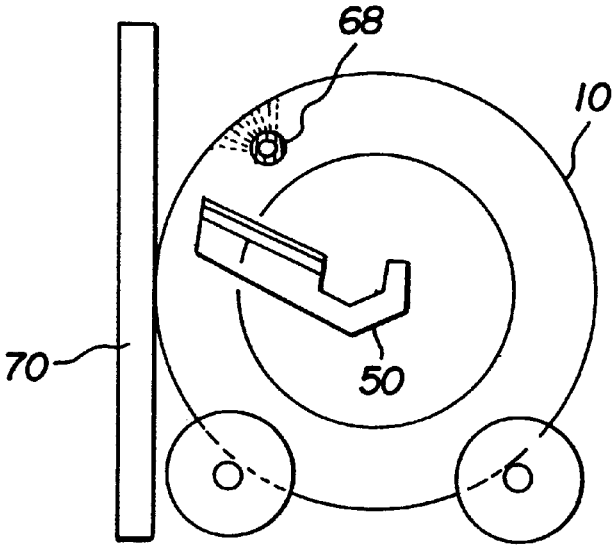
FIG. 9 shows a dandy pan in accordance with the present invention disposed within a dandy roll.

Dandy pans are of varying sizes, and can be over 150 inches in length and over 20 inches in width. Referring particularly to FIGS. 6–8, to provide structural strength, at least one rib 72 is disposed within dandy pan 50. Rib 72 is secured to top portion 58, typically by means of one of more tack welds 74, as illustrated in FIGS. 7 and 8. Holes 76 are provided within rib 72 for the circulation of the steam within the enclosed area. Applicant's existing dandy pan includes ribs 72 comprised of stainless steel 316L, a thickness of approximately 0.059 inches, and spaced approximately 12 inches apart (Z dimension as illustrated in FIG. 8).

The steam circulated within enclosed area 60 can be extremely hot, for example, at 225 degrees F. and 12 psi. When the liquid spray droplets fall onto dandy pan 50, cracks can occur on the dandy pan causing steam to escape. The escaping steam may adversely affect the characteristics of the paper being manufactured.

Attempts have been made to solve the problem of cracking by several methods. Consideration has been given to the view that cracking is a result of temperature and/or pressure. A focus has been on the consideration of pressure. Applicants have discovered that cracks generally occur on the top portion. Accordingly, one method believed to solve the problem included reducing pressure by strengthening top portion 58 through increasing it's thickness. However, such increased thickness did not reduce the stresses sufficiently, and further contributed to the weight of the dandy pan which makes the dandy pan difficult to install/remove.

Bowing of the dandy pan occurs. Thus, other methods proposed include increasing the strength of the dandy pan by altering the dimension of the dandy pan. Such methods may be costly and require additional structural components to an existing dandy pan.

Applicants conducted a stress analysis of the dandy pan using finite-element techniques. Through this stress analysis, Applicants noticed high stresses in the top portion, particularly in the area of the tack welds. Applicants have unexpectedly discovered that modifying the spacing (i.e., dimension Z) of ribs 72 affects the stresses on the top portion of the dandy pan, which in turn affects the cracking of the surface.

Applicants have unexpectedly discovered that reducing the spacing of ribs 72 from twelve inches reduces the stresses. Applicants have found that a spacing of equal to or less than approximately nine (9) inches suitably reduces the stresses. While reducing the spacing of the ribs to a minimum may further reduce the maximum stress, reducing the spacing of the ribs requires more ribs, and consequently, additional weight to the dandy pan. Thus, a solution is required which minimizes stress and weight. Applicants have discovered that an eight (8) inch spacing provides an optimum configuration wherein the weight of the dandy pan is manageable and the stresses on the surface of the shield are within a range to reduce the susceptibility to cracking. A spacing of less than six (6) inches is not preferable.

An experimental analysis of the dandy pan having a 12 inch rib spacing predicted a maximum stress of 69,074 psi in the area of the weld. A corresponding experimental analysis of the dandy pan having an 8 inch rib spacing predicted a maximum stress of 37,800 psi. This provides for an approximately 45 percent reduction in stress.

The invention has been described in detail with particular reference to a presently preferred embodiment, but it will be understood that variations and modifications can be effected within the spirit and scope of the invention. The presently disclosed embodiments are therefore considered in all respects to be illustrative and not restrictive. The scope of the invention is indicated by the appended claims, and all changes that come within the meaning and range of equivalents thereof are intended to be embraced therein.

What is claimed is:

1. A dandy pan for use in the manufacturing of paper material, comprising:

a base portion having a non-collection area, a collection area, and a plurality of insulating air pockets spaced from said collection area;

a top portion fixedly attached to the base portion to define an enclosed area through which steam is circulated; and a plurality of ribs disposed within the enclosed area, each of the plurality of ribs being secured to the top portion by at least one weld, the spacing of the ribs being equal to or less than approximately nine inches.

2. The dandy pan according to claim 1 wherein the spacing of the ribs is approximately eight inches.

3. The dandy pan according to claim 1 further comprising a top shield in overlapping spaced relationship to the top portion.

4. The dandy pan according to claim 3 wherein the top shield is fixedly attached to the top portion by a bracket.

5. An apparatus for the manufacturing of paper material, comprising:

a rotatable dandy roll; and a stationarily mounted dandy pan about which the dandy roll rotates, the dandy pan including:

(i) a base portion having a non-collection area, a collection area, and a plurality of air pockets spaced from said collection area;

(ii) a top portion fixedly attached to the base portion to define an enclosed area through which steam is circulated; and (iii) a plurality of ribs disposed within the enclosed area, each of the plurality of ribs being secured to the top portion by at least one weld, the spacing of the ribs being equal to or less than approximately nine inches; and a fluid dispenser dispensing water toward the dandy roll.

* * * * *